United States Patent [19]

Nishizawa

[11] 4,345,609

[45] Aug. 24, 1982

[54] RINSING AND DRYING APPARATUS

[76] Inventor: Hideyuki Nishizawa, 1-5-1, Nakazato-cho, Kita-ku, Tokyo, Japan

[21] Appl. No.: 179,831

[22] Filed: Aug. 20, 1980

[30] Foreign Application Priority Data

Aug. 28, 1979 [JP] Japan ..... 54-110012

[51] Int. Cl.[3] ..... B08B 9/00

[52] U.S. Cl. ..... 134/57 R; 134/115 R; 134/171; 34/104

[58] Field of Search ..... 134/57 R, 95, 103, 115 R, 134/171, 166 R; 34/104

[56] References Cited

U.S. PATENT DOCUMENTS

| | | | |
|---|---|---|---|
| 1,584,913 | 5/1926 | Wilson | 134/171 X |
| 2,319,531 | 5/1943 | Brown et al. | 134/171 UX |
| 2,548,363 | 4/1951 | Gray | 34/104 X |
| 2,643,465 | 6/1953 | Douglass | 134/103 X |
| 3,386,454 | 6/1968 | Kendt | 134/115 R X |
| 3,881,503 | 5/1975 | Fox et al. | 134/103 X |

FOREIGN PATENT DOCUMENTS

| | | | |
|---|---|---|---|
| 463040 | 10/1973 | Australia | 134/57 R |
| 1017929 | 12/1952 | France | 134/166 R |

*Primary Examiner*—Robert L. Bleutge
*Attorney, Agent, or Firm*—Fred Philpitt

[57] ABSTRACT

This invention relates to an apparatus for drying treatment of articles requiring the drying, and for rinsing and drying small glass tubes such as pipettes used in the chemical analysis or the like effectively.

5 Claims, 1 Drawing Figure

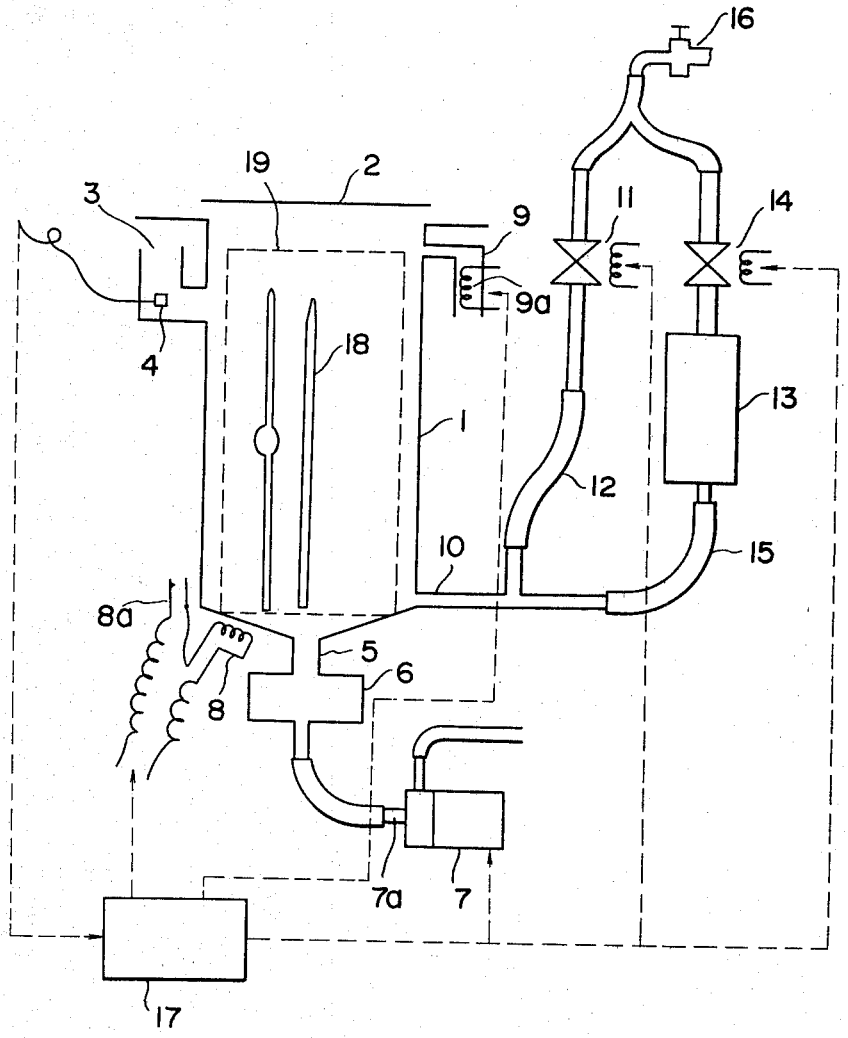
16
19
2
3
9
11
14
9a
4
18
13
1
12
10
15
8a
5
6
8
7a
7
17

RINSING AND DRYING APPARATUS

BACKGROUND OF INVENTION

In accordance with drying apparatus generally articles to be dried are accommodated inside of the vessel and heating and drying are applied to the inside of the vessel, and a temperature inside of the vessel is maintained at a temperature higher than a boiling point of water, the water content in the vessel is evaporated and the steam flows out through the space formed between the opening of the vessel and the cover provided on the upper end of the vessel, thereby drying the article. However, the pipettes are considered not to be heated to high temperature since they are precision gauges, and in case of maintaining the vessel at a temperature allowing the pipettes to be dried such as at a temperature from about 50° C. to about 80° C., the air in the tank comes to contain saturated steam at the drying temperature, which steam is cooled when the air containing the steam in the vessel contacts the cover, and a major portion of the steam in the air is settled and condensed to be dropped in the vessel so that the drying of the article by the foregoing means requires extremely long hours. As a method of resolving the problem, the pressure in the tank is reduced, and the drying is effected to low temperature, but an installation such as a pressure reduction pump is required, and at the same time, the apparatus becomes complicated, thereby easily raising the cost of the apparatus.

Also, on the other hand, a system of drying the pipettes by flowing dried hot air is well known but this system tends to cause adverse results of not only consuming a large volume of heat but also blowing dusts in the atmosphere to the pipettes and tends to require expenses together with the removal of the dusts from the air.

Also, the pipettes used in the field of chemical analysis or the like are small glass tubes whose ends are of small diameters and have complicated shapes. For this reason, the washing and drying after the involve with various problems.

The foregoing washing and drying are performed in the following manner. In the first place, the pipettes are dipped for washing in acidic washing solutions such as chromic acid mixed solution or in detergent solutions, or the pipettes are dipped in the detergent solutions, and supersonic waves are applied to the detergent solutions to effect the supersonic washing whereby the substances adhered on the pipettes are removed by dispersing them in the washing solution. Next, the washing with the city water is applied to the pipettes a plurality of times, and the chromic acid mixed solution or the detergent solution adhered to the pipettes is removed, and moreover, if necessary, the rinsing with the pure water is applied to the pipettes.

The foregoing rinsing, in many cases, is performed normally in the automatic rinsing device a of siphon type, and the final rinsing with the pure water is performed manually. The siphon device for performing this process automatically is found in the commercially available devices.

As described in the foregoing, the washed pipettes are dried by the drying treatment or the like in the proper drying unit.

The foregoing treatment comprises charging of the used pipettes into the washing solution, removal of the washed pipettes from the washing tank, charging of the pipettes taken out from the washing tank to the siphon type automatic rinsing device to the rack for drying or the drying unit after rinsing manually with the pure water. The washing of the pipettes is usually performed by handling a large number of pipettes so that each of the foregoing operations requires considerable processes and times. Although the labor required for each of the operations is not excessive, it is necessary to shift the pipettes to the next steps speedily upon completion of the processes and on account of the requirements, the monitoring of the processes is required, and if the monitoring is ignored, are wasted long hours and natural resources.

Furthermore, whether drying the pipettes or the like with the drying apparatus or in case of drying with the drying apparatus with heat from below the vessel which contains the pipettes in its inside, there are many problems remained to be solved.

DETAILED DESCRIPTION OF INVENTION

This invention is based on the foregoing circumstances, and its first object is to provide a drying apparatus capable of performing the drying of the article at a temperature below a boiling point of water.

A second object of this invention is to provide a drying apparatus capable of performing the rinsing and drying the article.

A third object of this invention is to provide a drying apparatus capable of performing the rinsing and drying of the article consistently and automatically.

A fourth object of this invention is to provide a drying apparatus capable of performing the rinsing of the article with pure water and drying it consistently and automatically.

The details of this invention will be described by referring to the accompanying drawing. The drawing is a schematic diagram of an embodiment of the present apparatus applied to the washing and drying of the small glass tubes such as pipettes.

The drawing shows the apparatus related to the present invention.

In the drawing, a vessel 1 has an opening on its upper end and its axis is perpendicular and its cross section is of circular shape, or square or proper shape, and a cover 2 not completely sealing the opening is provided on the opening surface. Also, at one side of the upper portion of the vessel 1, a water gauge chamber 3 communicated with the inside of the vessel 1 is provided and a water gauge 4 which generates an electric signal when a water level in the vessel 1 reaches a predetermined value by the pneumatic pressure in the water gauge chamber 3, and the water gauge is actually disposed outside of the tank, and is connected to the water gauge chamber by means of the tube.

The wall of the bottom surface of the vessel 1 is of convex shape in its lower portion, and a heater 8 is provided with a thermostat 8*a*, and a drain pipe 5 is connected to a top point of the convex shape. This drain pipe 5 is connected to a suction port 7*a* of a drain pump 7 by means of a retarding tank 6. On the outer surface of the wall of the bottom, an electric heater 8 is mounted.

Furthermore, on the upper portion of the vessel 1, there is provided a ventilating cylinder 9 communicating at its upper end with the inside of the vessel 1 and releasing at the lower end with the atmosphere, and an electric heater 9*a* of a small output is housed inside of the ventilating cylinder 9.

Also, a feed water pipe 10 is connected to the lower portion of the vessel 1, and the feed water pipe 10 is connected to a city water faucet 16 by means of a first duct 12 having an electromagnetic valve 11 in its middle and a second duct 15 having an ion exchange pure water unit 13 and an electromagnetic valve 14 in its middle and in parallel with the duct 12.

A control circuit 17 has the following functions. Namely, a control circuit 17 is constructed to control various operations including actuation of the drain pump 7 by an output signal of the water gauge 4, closure of the electromagnetic valve 11 in the middle of the first duct 12, stoppage of the drain pump 7 after the lapse of a required time for draining by the drain pump 7, release of the electromagnetic valve 11 in the middle of the first duct 12, actuation and stop of the drain pump 7, closure and release of the electromagnetic valve 11, release of the electromagnetic valve 14 in the second duct 15 after completion of the setting counts, actuation and stoppage of the drain pump 7 after the intake of water into the vessel 1 by means of the duct 15, and closure of the electromagnetic valve 14, stoppage of the drain pump 7 and energization of the electric heaters 8, 9a after the closure, which operations are sequential and automatic.

In the apparatus of this invention having the foregoing construction, a cage 19 for housing glass tubes 18 is provided inside of the vessel 1.

The rinsing and drying of the small glass tubes are performed in the following manner.

In the first place, the washed small glass tubes 18 are housed in the cage 19 in the vessel 1, the faucet 16 is opened, and the city water is poured into the vessel by means of the electromagnetic valve 11 in the released condition. When the water level in the vessel 1 reaches the set value, the water gauge 4 outside of the water gauge chamber 3 detects the water level, and the electromagnetic valve 11 is closed by the detected output, and the drain pump 7 is actuated. When the drain pump 7 is operated for a time sufficient to perform the draining by the timer and then is stopped, the electromagnetic valve 11 is released. Consequently, the supply of the city water is started, and when the water level in the vessel 1 reaches a set value, as described in the foregoing, the inside of the vessel 1 is drained. The feeding and draining of the water in the vessel 1 are such that such operations are repeated by the number of times set by the control circuit 17, and a plurality of the rinsings by the fresh city water are applied to the small glass tubes.

When the rinsing with the city water by a required number of times is over, the electromagnetic valve 14 in the second duct is released, and the city water from the faucet 16 is purified through ion exchange pure water unit 13 and is supplied to the vessel 1. When the water level in the vessel 1 reaches a set value, similar to the rinsing time with the city water, the inside of the vessel 1 is drained. The rinsing with the pure water is usually performed once, but if necessary, two or more rinses can be performed.

As described in the foregoing, after the rinsing with the pure water is over, the electric heaters 8, 9a are energized, and the drying of the small glass tubes 18 is performed.

In the processes of the rinsing, and drying, the retarding tank 6 and the ventilating cylinder 9 which are characteristic constituting elements of the apparatus of this invention function as follows. Namely, the retarding tank 6 prevents the counter flow of the residual water in the drain pipe 5 into the vessel 1 at the stop time of the drain pump 7, and functions as the staying area for the incomplete pure water of the initial period at the time of the start of the supply of the pure water and prevents the storing of the incomplete pure water in the vessel 1.

Also, the ventilating cylinder 9 functions as follows. In the first place, the inside of the vessel 1 is heated by the energization of the electric heater 8, and the water contents which are adhered to the small glass tubes 18, the inner surface of the vessel, and the cage 19 or the like are evaporated, and the air containing the vapor fills in the vessel 1. This condition appears even in the case where the heating with the electric heater to the lower portion is not taken place, and the air trapped in the wet tank comes to have a relative humidity close to 100%. The atmosphere is heated by a heater 9a in the ventilating cylinder producing air of extremely low relative humidity which passes through the inside of the tank, and escapes through the gap of the cover. An air layer of high temperature and low moisture is formed on the highest portion of the tank. This air layer is contacted and mixed with the air layer of lower temperature and higher moisture at a temperature higher than that heated in the tank, and therefore it performs the taking in of the moisture. The water content in the tank is therefore heated by the heater 9a, and is transferred to the outside of the tank together with the heated air. The supply of the high temperature air from the ventilating cylinder 9 to the inside of the vessel 1 is performed normally during the operation of the heater 9a so that the air of the outside of the tank is taken in from the lower part of the ventilating cylinder and is heated and is continuously supplied into the tank as the air of high temperature and low humidity and as the result, the removal of the moisture in the vessel due to the contact and mixture of the humid air with the high temperature air continuously takes place, whereby drying of the small glass tube 18 occurs speedily.

Since the molecular weight of water is 18, and is small as compared with the average molecular weight of air which is 29, the steam is lighter than the air, and the air containing a greater amount of moisture is light as compared with the air containing low moisture. Accordingly, the air which contains the steam in the inside of the drying vessel and which has high moisture gathers in the upper part of the vessel, and the contact with the air of high temperature and low moisture flowing in from the upper portion of ventilating cylinder 9 is takes place extremely and naturally.

However, in case the air in the upper layer is heated and its density is remarkably decreased, the convection by the moisture has a possibility of becoming insufficient, and as a countermeasure, a method of installing a heater at a low position in the tank to cause the convection by the heating, or a method of using a small size fan to stir the air or the similar methods will be necessary.

In the case of this invention, the role is played by the heater provided at the outside of its lower portion, but in order to perform the moisture removal and the drying in the tank by only the heated air current of the upper portion, there is a possibility of providing a drying unit including a mechanism of promoting the movement of the inside air without heat insulation of the side of the tank to introduce the evaporation heat from the atmosphere.

This invention is not limited to the foregoing embodiments. For example, in case of not requiring the rinsing with the pure water, the second duct 15 may be omitted. Also, in case of not requiring the automation of the rinsing operation, the control circuit 17 may be omitted, and each controlled device may be controlled manually.

Furthermore, in case of the mere drying apparatus, various mechanisms for water feeding and drainage may be omitted.

The invention has been described in considerable detail with particular reference to certain preferred embodiments thereof, but it will be understood that variations and modifications can be effected within the spirit and scope of the invention as described hereinabove, and as defined in the appended claims.

What is claimed is:

1. A drying apparatus comprising a vessel whose upper end is open; a cover detachable to the opening, which cover has no function of sealing the opening; a ventilating tube whose upper end is in communication with an upper portion of the vessel, said tube being provided with an electric heater in its inside and being in communication, at its lower end, with the atmosphere; a retarding tank being in communication with the lower end of the vessel; and a pump for draining the inside of the vessel by means of the retarding tank.

2. A drying apparatus as defined by claim 1 and further comprising an electric heater mounted on the bottom outside surface of the vessel.

3. A drying apparatus as set forth in claim 1 which further comprises a water gauge chamber provided with a gauge member communicating with the inside of the vessel at one side of an upper portion of said vessel; a drain pump communicating with the bottom surface of the vessel and draining the water from inside of the vessel; and a feed water pipe communicating at one end, with the lower portion of the vessel and at the other end, with a faucet of the city water, by means of an electromagnetic valve.

4. A drying apparatus as set forth in claim 3 wherein the feed water pipe is in parallel with a duct having therein an electromagnetic valve and an ion exchange pure water device, said duct being in communication, at one end, with the lower portion of the vessel and, at the other end, with a faucet of the city water.

5. A drying apparatus as set forth in the claim 3 or 4 wherein a control circuit is provided which performs the actuation of the drain pump by the detected output of the water gauge, closure of the electromagnetic valve, stoppage of the drain pump after lapse of a predetermined time upon the generation of the detected output, and performance of the release of the electromagnetic valve, and automatic energization of the each electric heater after repetition of a predetermined number of times of the operations.

* * * * *